United States Patent [19]

Kono et al.

[11] 4,252,310

[45] Feb. 24, 1981

[54] COPY PAPER SEPARATING DEVICE FOR USE IN ELECTROPHOTOGRAPHIC COPYING APPARATUS

[75] Inventors: Tateomi Kono, Toyokawa; Masaru Imaizumi, Shinshiro, both of Japan

[73] Assignee: Minolta Camera Kabushiki Kaisha, Osaka, Japan

[21] Appl. No.: 27,016

[22] Filed: Apr. 3, 1979

[30] Foreign Application Priority Data

Apr. 15, 1978 [JP] Japan ..... 53-50116[U]

[51] Int. Cl.[3] ..... B65H 29/56; G03G 15/00

[52] U.S. Cl. ..... 271/308; 271/DIG. 2; 355/3 SH

[58] Field of Search ..... 355/3 R, 3 SH, 14 SH; 271/307, 308, 309, 310, 311, 312, DIG. 2, DIG. 9

[56] References Cited

U.S. PATENT DOCUMENTS

| | | | |
|---|---|---|---|
| 3,450,402 | 6/1969 | Weiler | 271/308 |
| 3,820,776 | 6/1974 | Fujimoto et al. | 271/DIG. 2 X |
| 4,060,320 | 11/1977 | Doi et al. | 271/DIG. 2 X |
| 4,168,902 | 9/1979 | Golz | 271/DIG. 2 X |

FOREIGN PATENT DOCUMENTS

| | | |
|---|---|---|
| 2642707 | 2/1978 | Fed. Rep. of Germany . |
| 51-43136 | 3/1976 | Japan . |
| 53-39237 | 9/1978 | Japan . |

*Primary Examiner*—Fred L. Braun

*Attorney, Agent, or Firm*—Wenderoth, Lind & Ponack

[57] ABSTRACT

A copy paper separating device for use in an electrophotographic copying apparatus in which the separating claw is arranged to selectively contact and be spaced from the surface of a photoreceptor or fixed roller, and simultaneously to move in the direction of width of the surface of the photoreceptor or fixing roller through one operation of a driving unit so as to prevent damages to the surface of the photoreceptor or fixing roller.

10 Claims, 7 Drawing Figures

COPY PAPER SEPARATING DEVICE FOR USE IN ELECTROPHOTOGRAPHIC COPYING APPARATUS

BACKGROUND OF THE INVENTION

The present invention relates to an electrophotographic copying apparatus and more particularly, to a copy paper separating device for use in an electrophotographic copying apparatus.

Commonly, in electrophotographic copying apparatuses in which copy paper is adapted to be attracted to or adhere onto the surface of a photosensitive member or photoconductive photoreceptor for transferring an electrostatic latent image or developed toner powder image of an original formed on the photoreceptor surface onto the copy paper in a known manner, it is necessary to separate the copy paper from the photoreceptor surface after the transfer.

Conventionally, for separating the copy paper in the above described manner, there have mainly been proposed separating devices in which a separating claw or the like is arranged to contact the photoreceptor surface at all times or intermittently only during separation for peeling off the leading edge of the copy paper. In the known arrangement as described above, however, since the separating claw is fixed or stationary with respect to the widthwise direction of the photoreceptor surface, it always contacts the photoreceptor surface at the same locus. Therefore, the separating claw is arranged to lightly contact the photoreceptor surface by being urged thereagainst by spring means or balancing by a weight, etc., but still tends to damage part of the photoreceptor surface to form a stripe thereon due to repeated contacts therewith, with consequent reduction of the life of the photoreceptor.

In order to overcome the disadvantages as described above, the present applicants have proposed a transfer paper separating device, for example, in Japanese Laid Open Utility Model Application Jikkaisho 51-43136, in which the separating claw is adapted to move in a widthwise direction of the photoreceptor surface for uniform contact at positions dispersed over a wide range of the photoreceptor surface so as to protect the photoreceptor surface from being damaged at one position and to prolong the life of the photoreceptor. Similarly, for heat roller fixing devices of the electrophotographic copying apparatuses in which the copy paper is passed between a pair of fixing or heat rollers for fixing the toner powder image transferred onto the copy paper by heating, a separating claw and the like is adapted to contact the surface of one of the fixing rollers at all times or intermittently only during the separation to peel off the copy paper closely adhering to the surface of the fixing roller by engagement with the leading edge thereof in a manner similar to that for the photoreceptor for preventing the copy paper from winding around the fixing roller. Since the arrangement as described above also has a tendency to damage the coating layer formed on the fixing roller surface by the tip of the separating claw in the long run, thus resulting in uneven fixing, there has also been proposed a similar separating device, for example, in Japanese Utility Model Publication Jikkosho 53-39237.

In the known arrangements as described in the foregoing, however, since pivoting means for causing the separating claw selectively to contact or be spaced from the photoreceptor surface or fixing roller, and shifting means for moving the separating claw in the widthwise direction of the photoreceptor surface or fixing roller are provided independently, the separating device itself tends to have a large size and a complicated structure, thus involving troublesome procedures in assembly and adjustments thereof.

SUMMARY OF THE INVENTION

Accordingly, an essential object of the present invention is to provide a copy paper separating device for use in an electrophotographic copying apparatus in which pivoting means and shifting means for the separating claw is driven by one driving means so as to protect the photoreceptor surface or fixing roller surface against damage by the separating claw for prolonging the life of such surfaces.

Another important object of the present invention is to provide a copy paper separating device of the above described type which is compact in size and which functions accurately and with high reliability.

A further object of the present invention is to provide a copy paper separating device of the above described type which has a simple construction for facilitation of assembly and adjustments, and which can be readily incorporated into electrophotographic copying apparatuses at low cost.

In accomplishing these and other objects according to one preferred embodiment of the present invention, the copying paper separating device for use in an electrophotographic copying apparatus arranged to separate copy paper closely adhering to the surface of a photoreceptor or fixing roller generally includes pivoting means to cause the separating claw to pivot for selective contact with and to be spaced from the surface of the photoreceptor or fixing roller, shift means for gradually moving the separating claw in the widthwise direction of said surface, and driving means for driving the pivoting means and shift means in response to a signal synchronized with the transportation of the copy paper. The separating claw is caused to selectively contact and be spaced from the surface of the photoreceptor or fixing roller, and simultaneously to move in the widthwise direction of said surface by one operation of the driving means.

By the above arrangement according to the present invention, not only is the inconvenience of damaging the surface of the photoreceptor or fixing roller by the separating claw prevented with consequent longer life of said surface, but the size of the separating device is made compact, and the construction thereof is simplified for facilitating assembly and adjustments, with substantial elimination of the disadvantages inherent in the conventional arrangements of this kind.

BRIEF DESCRIPTION OF THE DRAWINGS

These and other objects and features of the present invention will become apparent from the following description taken in conjunction with the accompanying drawings, in which.

Before the description of the present invention proceeds, it is to be noted that like parts are designated by like reference numerals throughout the several views of the accompanying drawings.

DETAILED DESCRIPTION OF THE INVENTION

Figure 1:
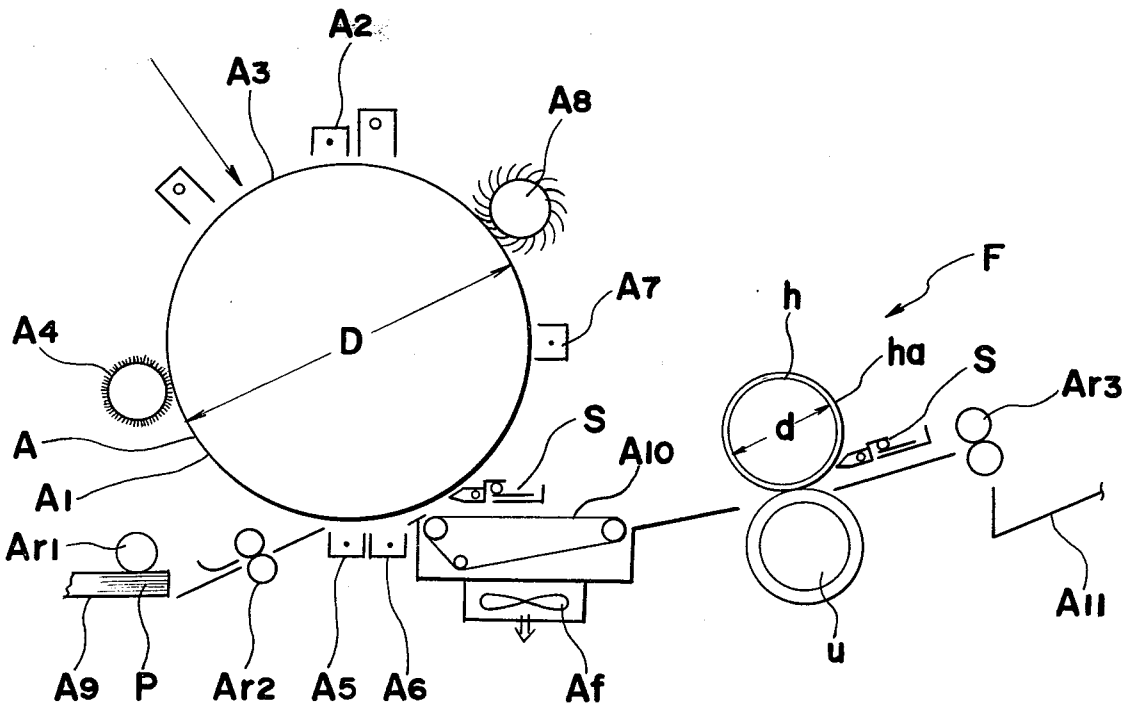
FIG. 1 is a schematic diagram illustrating one example of the construction of an electrophotographic copying apparatus and for explaining the positional relation of a copy paper separation device according to the present invention.

Referring now to the drawings, there is schematically shown in FIG. 1 one example of the general construction of an electrophotographic copying apparatus to which the copying paper separating device according to the present invention may be applied.

In FIG. 1, around a rotatable photosensitive member or photoreceptor drum A having a photoconductive photoreceptor surface A1, there are sequentially disposed in a known manner various processing stations such as a charging station with a corona charger A2 for preliminarily charging the photoreceptor surface A1, an exposure station A3 at which the light image of an original (not shown) to be copied is projected onto the photoreceptor surface A1 through an optical system (not shown) to form thereon an electrostatic latent image of the original, a developing station having a developing device A4 for developing the electrostatic latent image into a visible toner image, a transfer station equipped with a transfer charger A5 for transferring the visible toner image onto a copy paper sheet P fed from a copy paper cassette A9 by transportation rollers Ar1 and Ar2, guide plates, etc. a separating discharger A6, a charge erasing station with an AC discharger A7, and a cleaning station having a cleaning unit A8. The copy paper sheet P bearing the visible toner image thus transferred thereon is separated from the photoreceptor surface A1 by the separating charger A6 and the copy paper separating device S directly related to the present invention so as to be further transported, by a transportation belt A10 movably supported by a plurality of rollers in a position subsequent to the separating charger A6 and associated with a suction fan Af, to a fixing device F including a fixing or heat roller h having a diameter d smaller than the diameter D of the photoreceptor drum A, a pressing roller u normally urged against the surface ha of the heat roller h by suitable means (not shown), and a copy paper separating device S having the same construction and function as that employed for the photoreceptor drum A for peeling from the heat roller h a copy paper sheet P which may adhere to the surface ha of the heat roller h due to fusing of the toner. Subsequently, the copy paper sheet P having the copied image thus fixed thereon is discharged onto a tray A11 by transporting rollers Ar3 for completion of one copying operation.

In the first place, it is to be noted here that although the copy paper separating device according to the present invention will be described hereinbelow as applied to the photoreceptor drum A for brevity, such a separating device can also readily be applied to the fixing device F including the heat roller h of the smaller diameter d and the pressing roller u as described above as required.

Figure 2:
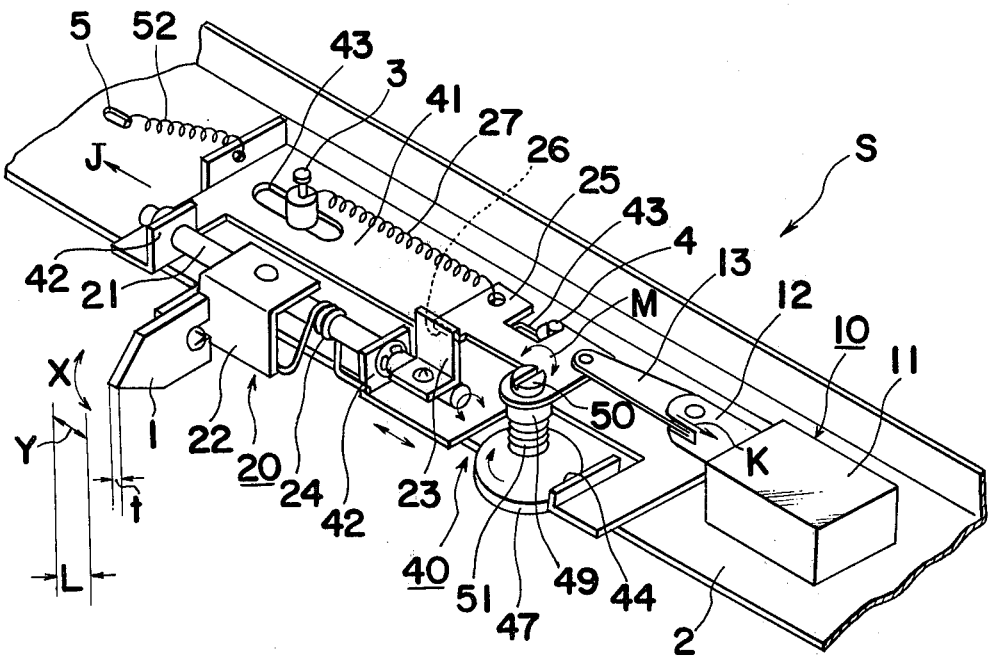
FIG. 2 is a perspective view showing the construction of a copy paper separating device according to one preferred embodiment of the present invention.
Figure 3:
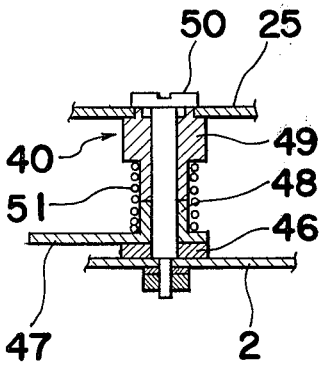
FIG. 3 is a cross sectional view of separating claw shifting means employed in the arrangement of FIG. 2.

Referring to FIGS. 2 and 3, the copy paper separating device S according to one preferred embodiment of the present invention generally includes driving means 10, pivoting means 20 for subjecting a separating claw 1 to pivotal movement in the directions shown by the arrow X in FIG. 2 so as to cause the separating claw 1 to selectively contact or be spaced from the surface of the photoreceptor drum A or fixing roller h, for example, from the surface A1 of the photoreceptor drum A, and shifting means 40 for moving the separating claw 1 little by little in the widthwise direction (indicated by the arrow Y in FIG. 2) of the photoreceptor surface A1, which means are mounted on a base 2 in a manner as described hereinbelow.

The driving means 10 further includes a solenoid 11 mounted on the base 2 and selectively turned ON or OFF, for example, by electrical signals synchronized with the transportation of copy paper P by control by a micro-computer (not shown), while the plunger 12 of the solenoid 11 is arranged to be retracted in the direction of the arrow K in FIG. 2 when the solenoid 11 is turned ON or energized and to be advanced by the urging force of a spring 27 described later upon turning OFF or de-energization of the solenoid 11.

The pivoting means 20 further includes a separating claw base plate 41 fixedly mounted on the base 2, a support shaft 21 rotatably supported at opposite ends thereof by a pair of spaced bent portions 42 extending upwardly from the base plate 41, a support piece 22 which supports the separating claw 1 and an engaging lever 23 fixedly mounted on the shaft 21, and a wire spring 24 wound around the shaft 21 for normally urging the separating claw 1 upwardly in FIG. 2 in a direction to contact the surface A1 of the photoreceptor drum A. A lever 25 rotatably mounted, at its one end, on a cam shaft 50 of the shifting means 40 described later for rotation in the direction shown by the arrow M in FIG. 2 is connected to the plunger 12 of the solenoid 11 through another lever 13 and has a regulating piece 26 provided at the other end of the lever 25 to contact the engaging lever 23 secured to the shaft 21. The lever 25 is normally urged counterclockwise in FIG. 2 about the cam shaft 50 by the spring 27 connected between the lever 25 and a guide pin 3 secured to the base 2, while the counterclockwise rotation of the lever 25 is restricted by contact of one edge of a cut-out portion formed in the lever 25 with another guide pin 4.

It is to be noted here that the tension of the spring 27 is larger than the spring force of the wire spring 24 for the separating claw 1.

On the other hand, for the shifting means 40, the separating claw base plate 41 has, elongated openings 43 formed therein through which the guide pins 3 and 4 on the base 2 extend for slidably mounting the plate 41 on the pins 3 and 4 for sliding movement in the widthwise direction of the photoreceptor surface A1 together with the separating claw 1, and a braking member 46, an eccentric cam 47, a boss member 49 and the lever 25 are mounted on the base 2 by the cam shaft 50 for rotation about said cam shaft 50, and a kick spring 51 is wound around the boss portion 48 of the eccentric cam 47 and the boss member 49 as is most clearly seen in FIG. 3. The boss member 49 is adapted to rotate simultaneously with the lever 25, while the kick spring 51 is arranged to clamp the boss member 49 to the boss portion 48 of the eccentric cam 47 during clockwise rotation of the boss member 49 together with the lever 25 for causing the eccentric cam 47 to rotate in the clockwise direction, and to be loosened to a certain extent when the boss member 49 is rotated counterclockwise for permitting said boss member 49 to rotate free of the boss portion 48 by slippage therebetween. The separating claw base plate 41 is normally urged in the direction indicated by the arrow J in FIG. 2 by a shift spring 52 connected between one end of the base plate 41 and an opening 5 formed in the base 2, and a bent edge 44 which extends upwardly from an inner edge of the other end of the base plate 41 contacts the peripheral surface of the eccentric cam 47.

By the above arrangement, when the solenoid 11 is in the OFF or de-energized state, the lever 25 is rotated counterclockwise by the spring 27, and the engaging lever 23 contacts the regulating piece 26 of the lever 25 for blocking rotation of the claw 1 due to the urging force of the wire spring 24, with consequent spacing of the separating claw 1 from the photoreceptor surface A1. However, when the solenoid 11 is turned ON or energized by the electrical signal synchronized with the transportation of the copy paper sheet P immediately before the leading edge of the copy paper sheet P reaches the separating position on the photoreceptor surface A1, the plunger 12 and the lever 13 connected thereto are retracted, and by the consequent rotation of the lever 25 about the cam shaft 50 for freeing the regulating piece 26 of the lever to permit the spring 24 to rotate the claw 1, the separating claw 1 is rotated upwardly in FIG. 2 about the shaft 21 to contact the photoreceptor surface A1.

Simultaneously with the rotation of the lever 25, the boss member 49 of the shifting means 40 rotates clockwise so as to tighten the kick spring 51, and the eccentric cam 47 is rotated in the clockwise direction. Following this clockwise rotation, the separating claw base plate 41 is slightly shifted either leftward or rightward to correspond to the eccentricity of the eccentric cam 47.

After the leading edge of the copy paper is separated due to the contact of the separating claw 1 with the surface A1 of the photoreceptor A, the solenoid 11 is turned OFF and the lever 25 is rotated counterclockwise by the action of the return spring 27. As the plunger 12 advances together with the lever 13, the regulating piece 26 of the lever 25 depresses the engaging lever 23, whereby the separating claw 1 is rotated downwardly in FIG. 2 so as to be spaced from the photoreceptor surface A1. The counterclockwise rotation of the boss member 49 simultaneously with the rotation of the lever 25 results in loosening of the spring 51 without rotation of the eccentric cam 47.

More specifically, the separating claw 1 is pivoted to contact and be spaced from the photoreceptor surface A1 at the time of each ON and OFF operation of the solenoid 11, while being moved little by little together with the base plate 41 in the widthwise direction of the photoreceptor surface A1, and completes one going and returning motion in the widthwise direction during one rotation of the eccentric cam 47.

The brake member 46 of the above described shift means 40 functions to prevent the reverse rotation of the eccentric cam 47 which tends to take place during the counterclockwise rotation of the lever 25, while the shift spring 52 functions to stably move the separating claw 41 in the widthwise direction following the rotation of the eccentric cam 47. The number of ON and OFF cycles of the solenoid 11 during one reciprocation of the separating claw 1 in the widthwise direction of the photoreceptor surface A1, i.e. the number of contacts of the separating claw 1 with the photoreceptor surface A1 may be suitably selected by altering the degree of tightening or length of the spring 51 or by changing the rotational angle of the lever 25. Similarly, the stroke of the separating claw base plate 41 may be varied by replacing the eccentric cam 47 with another eccentric cam having a different eccentricity.

It is to be noted here that in the foregoing embodiment, although the shift means 40 is arranged to move the separating claw 1 in the widthwise direction to a certain extent by rotation of the eccentric cam through a predetermined angle during energization of the solenoid 11, the arrangement may be modified so that the separating claw 1 is moved during de-energization of the solenoid 11 by changing the direction of winding of the spring 51.

Figure 4:
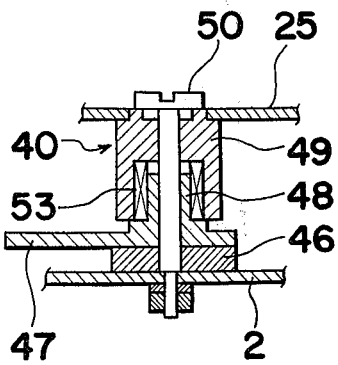
FIG. 4 is a view similar to FIG. 3, which particularly shows a modification thereof.

In the modification of the shift means 40 shown in FIG. 4, the spring 51 described as employed in the arrangement of FIG. 3 is replaced by a one-way clutch 53 provided between the boss portion 48 of the eccentric cam 47 and the boss member 49, and the remainder of the construction and function are generally similar to the arrangement of FIG. 3.

Figure 5:
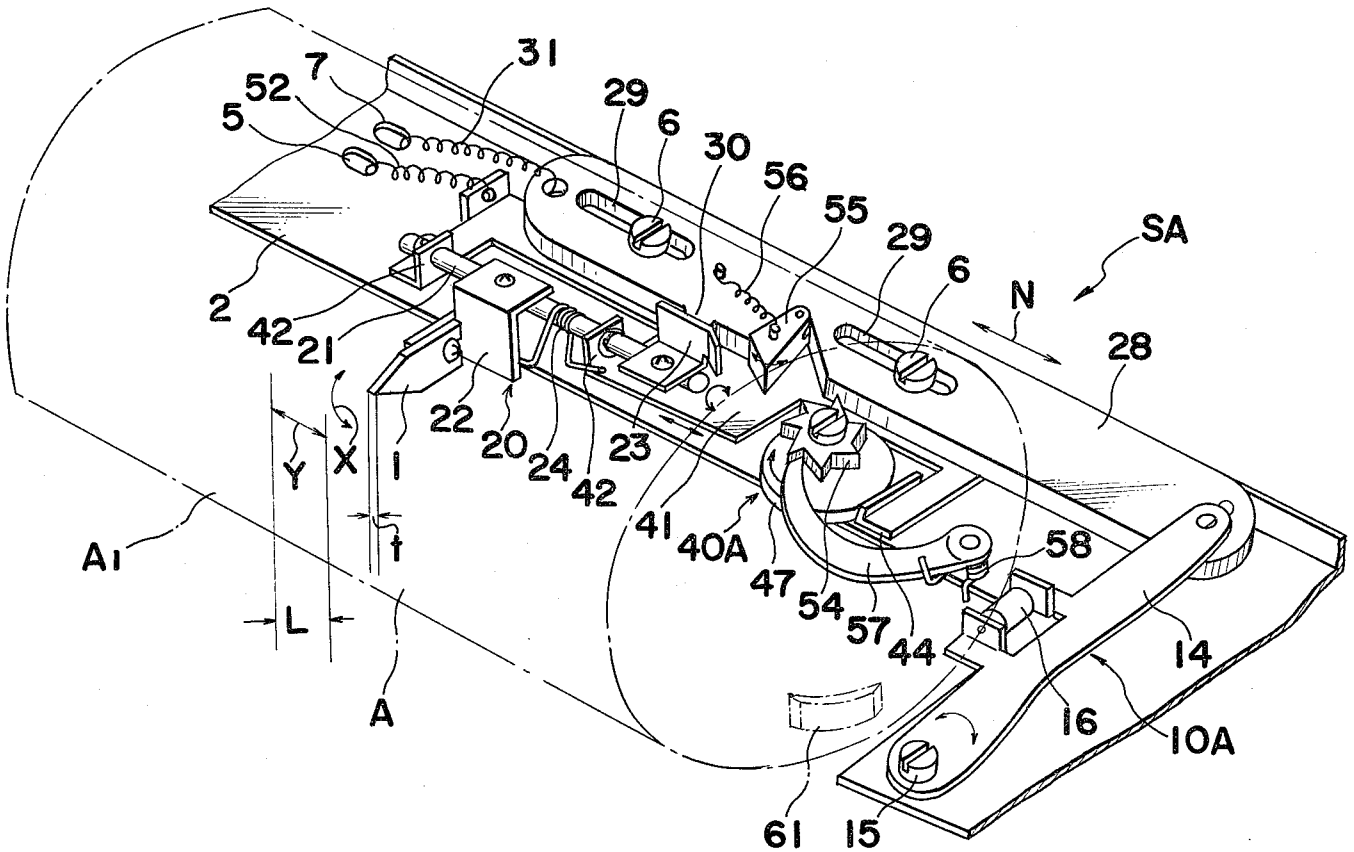
FIG. 5 is a view similar to FIG. 2, which particularly shows a first modification thereof.

Referring now to FIG. 5, there is shown a first modification of the copy paper separating device S of FIGS. 2 and 3. In the modified copy paper separating device SA of FIG. 5, the driving means 10 including the solenoid 11 and shift means 40 including the eccentric cam arrangement described as employed in the separating device S of FIGS. 2 and 3 are replaced by driving means 10A and shifting means 40A in the manner as described hereinbelow.

In FIG. 5, the driving means 10A generally includes a driving lever 14 pivotally mounted at one end thereof on the base 2 by a pin 15, a roller 16 rotatably mounted at approximately the central portion of the driving lever 14, and a cam member 61 formed on a corresponding side wall of the photoreceptor drum A for contact with said roller 16 as the photoreceptor drum A rotates. To the other end of the driving lever 14, there is pivotally connected a lever 28 which has elongated openings 29 formed therein through which corresponding guide pins 6 secured to the base 2 extend for slidably mounting the lever 28 on the pins 6 for movement in the direction indicated by the arrow N in FIG. 5 and which is urged leftward by a return spring 31 connected between the other end of the lever 28 and an opening 7 formed in the base 2, and the urging force of the spring 31 is limited by the contact of the edges of the elongated openings 29 with the guide pins 6. On one inner side edge of the lever 28, there is formed a regulating projection 30 for contact with the engaging lever 23 of the pivoting means 20.

The shift means 40A has a ratchet wheel mechanism which includes a ratchet wheel 54 mounted on the same shaft as the eccentric cam 47, a feeding claw 55 pivotally mounted on the lever 28 and normally urged clockwise by a coiled spring 56 connected between a projection provided on the feeding claw 55 and another projection formed on the lever 28, and a return prevention claw 57 pivotally mounted at its one end on the base 2 and normally urged clockwise by a wire spring 58 for engagement with the teeth of the ratchet wheel 54.

In the modified arrangement as described above, when the cam member 61 of the photoreceptor drum A is not in contact with the roller 16 of the driving lever 14, the lever 28 is shifted to the left in FIG. 5 by the action of the return spring 31, while the driving lever 14 is rotated counterclockwise about the pin 15. In the above state, the contact of the engaging lever 23 of the pivoting means 20 with the regulating projection 30 of the lever 28 blocks rotation of the claw 1 by the urging force of the wire spring 24, the separating claw 1 is spaced from the photoreceptor surface A1. When the cam member 61 contacts the roller 16 during the counterclockwise rotation of the photoreceptor drum A, the driving lever 14 is rotated clockwise, and the lever 28 is shifted toward the right, with consequent releasing of the restricting projection 30 for the engaging lever 23, and thus, the separating claw 1 is pivoted upwardly in FIG. 5 by the force of the wire spring 24 to contact the photoreceptor surface A1. Simultaneously with the movement of the lever 28, the feeding claw 55 engages the teeth of the ratchet wheel 54 to advance the ratchet wheel by one pitch, with consequent clockwise rotation of the eccentric cam 47 by one pitch. By the above rotation, the separating claw 1 is moved in the widthwise direction of the photoreceptor surface A1 together with the separating claw base plate 41.

When the cam member 61 is disengaged from the roller 16 upon further rotation of the photoreceptor drum A, the lever 28 is shifted toward the left for returning, while the driving lever 14 is rotated counterclockwise and the engaging lever 23 is depressed by the regulating projection 30 of the lever 28, and thus, the separating claw 1 is rotated downwardly in FIG. 5 so as to be spaced from the photoreceptor surface A1. Simultaneously, since the ratchet wheel 54 is in engagement with the returning prevention claw 57, the feeding claw 55 rides over the teeth of the ratchet wheel 54 for returning, without rotation of the eccentric cam 47. More specifically, the eccentric cam 47 rotates by one pitch of the ratchet wheel 54 for every reciprocation of the lever 28 by contact of the cam member 61 of the photoreceptor drum A with the roller 61 for moving the separating claw 1 in the widthwise direction of the photoreceptor surface A1.

In the foregoing arrangement, the cam 61 of the photoreceptor drum A is so disposed as to contact the roller 16 of the driving lever 14 before the leading edge of the copy paper reaches the separating position and to be disengaged from the roller 16 after the leading edge of the copy paper has been separated from the photoreceptor surface A1.

It should be noted that the arrangement of FIG. 5 may be modified so that the ratchet wheel 54 is advanced when the lever 28 has been shifted toward the left for rotating the eccentric cam 47, if the orientation of the feeding claw 55 and direction of the teeth of the ratchet wheel 54 are reversed, with simultaneous alteration of the shape of the returning prevention claw 57. Needless to say, the driving means 10A of FIG. 5 may be replaced by the driving means 10 of FIG. 2 employing the solenoid system.

Figure 6:
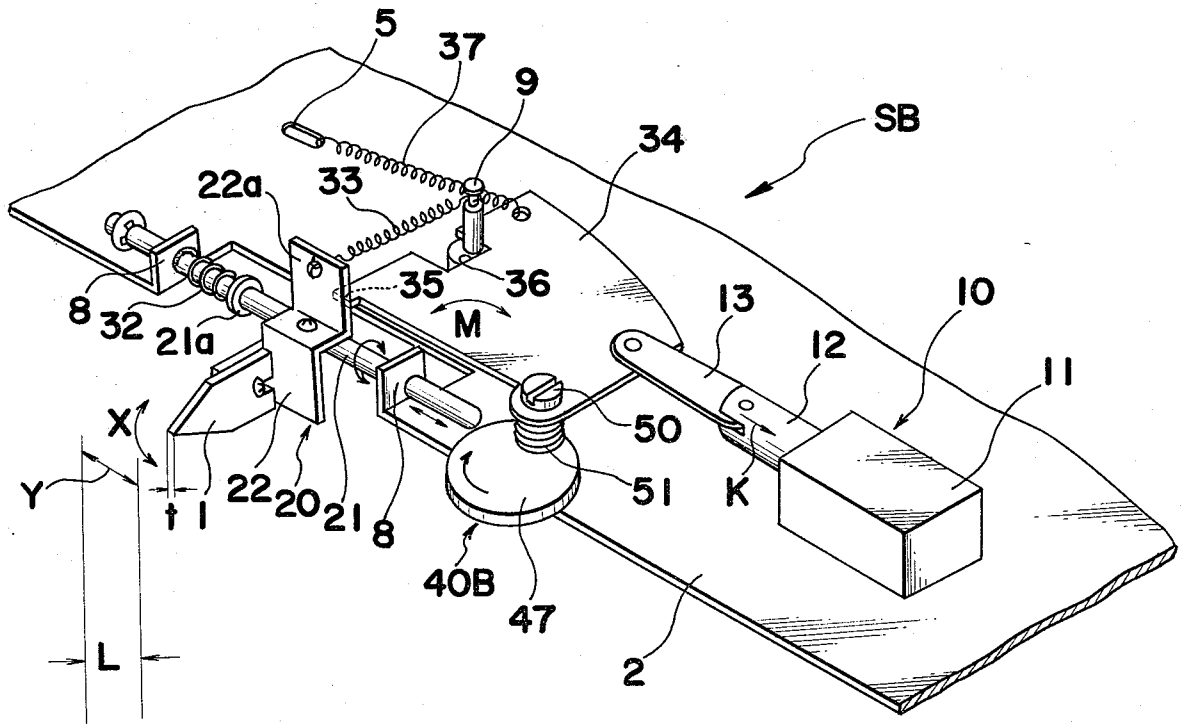
FIG. 6 is also a view similar to FIG. 2, which particularly shows a second modification thereof.
Figure 7:
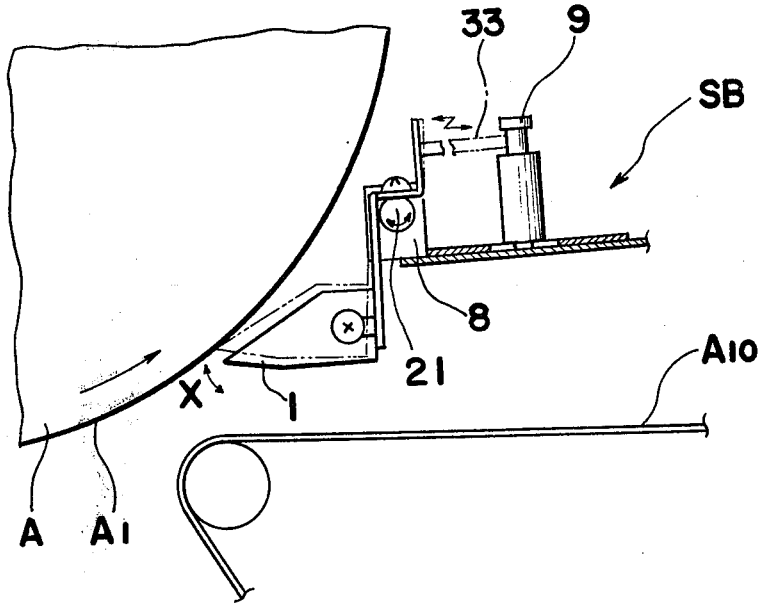
FIG. 7 is a sectional view of the modified arrangement of FIG. 6 for explaining the relation between the copy paper separating claw and the photoreceptor or fixing roller.

Referring now to FIGS. 6 and 7, there is shown a second modification of the copy paper separating device S of FIG. 2. In the copy paper separating device SB of FIG. 6, the separating claw base plate 41 described as employed in the shifting means 40 of FIG. 2 is dispensed with, and in the modified shifting means 40B of FIG. 6, the support shaft 21 for the separating claw 1 is arranged to be directly moved by the eccentric cam 47 in the manner as described hereinbelow.

More specifically, in FIGS. 6 and 7, the support shaft 21 is rotatably supported by the bent pieces 8 of the base 2 so as to be movable in the axial direction (i.e. in the widthwise direction of the photoreceptor surface A1) and is normally urged to the right in FIG. 6 by a coil spring 32 mounted on the shaft 21 between one of the bent pieces 8 supporting one end of the shaft 21 and a collar **21*a* on the shaft 21, while the other end of the shaft 21 extending through the other bent piece 8 contacts the peripheral edge of the eccentric cam 47. The separating claw 1 is normally urged upwardly by a spring 33 connected between an engaging portion 22*a* extending upwardly from the support piece 22 and a pin 9 secured to the base 2, with the urging force being restricted by the contact of the engaging portion 22*a* with a regulating piece 35 formed on a corresponding edge of a lever 34. The lever 34 is rotatably mounted on the cam shaft 50 in a manner similar to the lever 25 in the arrangement of FIG. 2 and is connected to the plunger 12 of the solenoid 11 through the lever 13 and is normally urged counterclockwise by a return spring 37 connected between the other end of the lever 34 and the opening 5 formed in the base 2 and having a biasing force larger than that of the coil spring 33 for the separating claw 1, with the urging force being restricted by the contact of a notched portion 36 formed in the lever 34 with the pin 9. Since the mechanism for rotating the eccentric cam 47 for the shift means 40B utilizes the spring 51 in a manner similar to that of the arrangement of FIG. 2**, a detailed description thereof is omitted for brevity.

By the arrangement of FIGS. 6 and 7, in a manner similar to that for the embodiment of FIG. 2, upon energization of the solenoid 11, the lever 34 rotates in the clockwise direction, and the separating claw 1 is pivoted upwardly in FIG. 6 to contact the photoreceptor surface A1, while simultaneously, the eccentric cam 47 rotates through a predetermined angle, and by the movement of the support shaft 21 in the axial direction following the rotation of the cam 47, the separating claw 1 is reciprocatingly moved little by little in the widthwise direction of the photoreceptor surface A1.

Hereinbelow, one reciprocating movement of the separating claw 1 in the widthwise direction in the foregoing embodiments will be described with reference to specific examples and numerical values.

On the assumption that the width or thickness t of the separating claw 1 is 2 mm, the distance of movement L of the separating claw 1 is 12 mm, and the amount of movement of the separating claw 1 each time it is actuated is denoted by l, in the case of the ratchet mechanism, the movement for one reciprocation (i.e. angle of rotation of the eccentric cam) is constant. Therefore, the number of copies N which are made during the movement of the separating claw through the distance L is represented by $$N=L/l$$

and under the conditions represented by $N \geqq L/t$ to eliminate portions out of contact with the separating claw within the range of L, the relation $l \leqq t$ is derived from $L/l \geqq L/t$. However, since in actual practice, the separating claw does not contact the photoreceptor surface over its entire width, but only over a part of the width thereof, the conditions represented by $l << t$ are actually preferable and thus, one reciprocation per twenty to several hundreds of copy paper sheets (preferably 100 to 200 sheets in actual practice) causes no particular problems. In the case of the kick spring, however, since the rotational angle of the eccentric cam each time can not be set to be very large, the number of copies to be made will be over fifty sheets per one reciprocating movement.

It should be noted here that in the foregoing embodiments, the copy paper separating device according to the present invention is mainly described with reference to separation of copy paper closely adhering to the photoreceptor surface. The separating device of the invention is readily applicable to separation of copy paper adhering to the surface of the fixing roller, the only difference being that the fixing roller has a diameter smaller than that of the photoreceptor drum, and therefore, a detailed description thereof with reference to the fixing roller is omitted here for brevity.

As is clear from the foregoing description, in the arrangement according to the present invention, since the separating claw is adapted to selectively contact or be spaced from the photoreceptor surface or fixing roller surface by the pivoting means, and also to be moved gradually in the direction of the width of the photoreceptor surface or fixing roller surface by the shift means, the disadvantage in the conventional arrangements of damaging the photoreceptor surface or fixing roller surface by the separating claw is prevented, with consequent prolonged life of the photoreceptor surface or fixing roller surface. Furthermore, by the arrangement of the invention in which the pivoting means and shifting means are driven by one driving means, the size of the separating device can be made compact as compared with the conventional separating devices requiring two driving means, and the construction can be simplified. Moreover, since the separating device of the present invention can be readily incorporated into copying apparatuses after assembling and adjustments thereof outside the copying apparatus, such assembling and adjustments are markedly facilitated.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as being included therein.

What is claimed is:

1. A copy paper separating device for use in an electrophotographic copying apparatus for separating copy paper from a rotating surface of a rotary member, said device comprising: a separating claw for engaging the rotating surface to separate the paper therefrom; pivoting means on which said claw is mounted to alternately pivot said claw into contact with and to space said claw from the rotating surface of said rotary member, said pivoting means including a rotatable support means holding said separating claw, a spring member engaging said support means and normally urging said separating claw in a direction to contact said rotating surface, and a regulating member normally engaging said pivoting means for blocking rotation of said pivoting means due to the urging force of said spring member so as to cause the separating claw to be spaced from the rotating surface of said rotary member; shift means connected to said claw for gradually moving said claw in the widthwise direction of said rotating surface and including a base member on which said rotatable support means is mounted and movable in the widthwise direction of said rotating surface of said rotary member, a rotatable eccentric cam member engaged with said base member for moving said base member, and a control member which causes said eccentric cam member to rotate in one direction when driven in one direction and to cause said cam member to remain in position when said control member is driven in the opposite direction; and driving means connected to said pivoting means and said shift means for moving said regulating member out of engagement with said pivoting means and for driving said control member in said one direction when said driving means is operating in the driving mode and for permitting said regulating member to again block said pivoting means and for moving said control member in the said other direction when said driving means is in the off mode, said driving means being operable in the driving and off modes in synchronization with the movement of the copy paper in the copying apparatus.

2. A copy paper separating device for use in an electrophotographic copying apparatus for separating copy paper from a rotating surface of a rotary member, said device comprising: a separating claw for engaging the rotating surface to separate the paper therefrom; pivoting means on which said claw is mounted to alternately pivot said claw into contact with and to space said claw from the rotating surface of said rotary member, said pivoting means including a rotatable support means holding said separating claw, a spring member engaging said support means and normally urging said separating claw in a direction to contact said rotating surface, and a regulating and control member normally engaging said pivoting means for blocking rotation of said pivoting means due to the urging force of said spring member so as to cause the separating claw to be spaced from the rotating surface of said rotary member; shift means connected to said claw for gradually moving said claw in the widthwise direction of said rotating surface and including a base member on which said rotatable support means is mounted and movable in the widthwise direction of said rotating surface of said rotary member, and a rotatable eccentric cam member engaged with said base member for moving said base member, said regulating and control member being connected to said eccentric cam member for rotating said eccentric cam member in one direction when driven in one direction and to cause said cam member to remain in position when said regulating and control member is driven in the opposite direction; and driving means connected to said regulating and control member for moving said regulating and control member out of engagement with said pivoting means and for driving said regulating and control member in said one direction when said driving means is operating in the driving mode and for permitting said regulating and control member to again block said pivoting means and for moving said regulating and control member in the said other direction when said driving means is in the off mode, said driving means being operable in the driving and off modes in synchronization with the movement of the copy paper in the copying apparatus.

3. A copy paper separating device as claimed in claim 2, wherein a one-way clutch means is connected between said eccentric cam member and said regulating and control member.

4. A copy paper separating device as claimed in claim 2, wherein a ratchet wheel mechanism is connected between said eccentric cam member and said regulating and control member.

5. A copy paper separating device as claimed in claim 1 or claim 2, wherein said driving means includes a solenoid mechanism operated by an electrical signal synchronized with the transportion of the copy paper through said apparatus.

6. A copy paper separating device as claimed in claim 1 or claim 2, wherein said driving means includes a lever member and a cam piece on one end of said rotary member engagable with said lever for actuating said lever to drive said pivoting means and said shift means each time said rotary member rotates.

7. A copy paper separating device for use in an electrophotographic copying apparatus for separating copy paper from a rotating surface of a rotary member, said device comprising: a separating claw for engaging the rotating surface to separate the paper therefrom; pivoting means on which said claw is mounted to alternately pivot said claw into contact with and to space said claw from the rotating surface of said rotary member, said pivoting means including a rotatable support means holding said separating claw and being movable in the widthwise direction of said rotary surface, a spring member engaging said support means and normally urging said separating claw in a direction to contact said rotating surface, and a regulating member normally engaging said pivoting means for blocking rotation of said pivoting means due to the urging force of said spring member so as to cause the separating claw to be spaced from the rotating surface of said rotary member; shift means connected to said rotatable support means for gradually moving said claw in the widthwise direction of said rotating surface and including a rotatable eccentric cam member engaged with said rotatable support means for moving said rotatable support means, and a control member which causes said eccentric cam member to rotate in one direction when driven in one direction and to cause said cam member to remain in position when said control member is driven in the opposite direction; and driving means connected to said pivoting means and shift means for moving said regulating member out of engagement with said pivoting means and for driving said control member in said one direction when said driving means is operating in the driving mode and for permitting said regulating member to again block said pivoting means and for moving said control member in the said other direction when said driving means is in the off mode, said driving means being operable in the driving and off modes in synchronization with the movement of the copy paper in the copying apparatus.

8. A copy paper separating devices as claimed in claim 7, wherein a one-way clutch means is connected between said eccentric cam member and said control member.

9. A copy paper separating device as claimed in claim 7, wherein a ratchet wheel mechanism is connected between said eccentric cam member and said control member.

10. A copy paper separating device for use in an electrophotographic copying apparatus for separating copy paper from a rotating surface of a rotary member, said device comprising: a separating claw for engaging the rotating surface to separate the paper therefrom; pivoting means on which said claw is mounted to alternately pivot said claw into contact with and to space said claw from the rotating surface of said rotary member, said pivoting means including a rotatable support means holding said separating claw and being movable in the widthwise direction of said rotary surface, a spring member engaging said support means and normally urging said separating claw in a direction to contact said rotating surface, and a regulating and control member normally engaging said pivoting means for blocking rotation of said pivoting means due to the urging force of said spring member so as to cause the separating claw to be spaced from the rotating surface of said rotary member; shift means connected to said rotatable support means for gradually moving said claw in the widthwise direction of said rotating surface and including a rotatable eccentric cam member engaged with said rotatable support means for moving said rotatable support means, said regulating and control member being connected to said eccentric cam member for rotating said eccentric cam member in one direction when driven in one direction and to cause said cam member to remain in position when said regulating and control member is driven in the opposite direction; and driving means connected to said regulating and control member for moving said regulating and control member out of engagement with said pivoting means and for driving said regulating and control member in said one direction when said driving means is operating in the driving mode and for permitting said regulating and control member to again block said pivoting means and for moving said regulating and control member in the said other direction when said driving means is in the off mode, said driving means being operable in the driving and off modes in synchronization with the movement of the copy paper in the copying apparatus.

* * * * *